US009711103B2

(12) United States Patent
Lee et al.

(10) Patent No.: US 9,711,103 B2
(45) Date of Patent: Jul. 18, 2017

(54) DISPLAY APPARATUS

(71) Applicant: Samsung Display Co., Ltd., Yongin, Gyeonggi-Do (KR)

(72) Inventors: Jae-Han Lee, Hwaseong-si (KR); Taegon Kim, Busan (KR); Sunkyu Son, Suwon-si (KR); ByungKil Jeon, Hwaseong-si (KR); Dong-Hyun Yeo, Yongin-si (KR)

(73) Assignee: Samsung Display Co., Ltd. (KR)

( * ) Notice: Subject to any disclaimer, the term of this patent is extended or adjusted under 35 U.S.C. 154(b) by 133 days.

(21) Appl. No.: 14/693,754

(22) Filed: Apr. 22, 2015

(65) Prior Publication Data

US 2016/0104450 A1 Apr. 14, 2016

(30) Foreign Application Priority Data

Oct. 14, 2014 (KR) ..... 10-2014-0138447

(51) Int. Cl.
*G09G 3/36* (2006.01)

(52) U.S. Cl.
CPC ..... *G09G 3/3688* (2013.01); *G09G 3/3611* (2013.01); *G09G 3/3696* (2013.01); *G09G 2310/08* (2013.01); *G09G 2320/041* (2013.01); *G09G 2330/045* (2013.01); *G09G 2352/00* (2013.01); *G09G 2370/08* (2013.01)

(58) Field of Classification Search
CPC ..... G09G 3/3688; G09G 3/3611; G09G 2370/08; G09G 2320/041; G09G 2352/00; G09G 3/3696; G09G 2330/045; G09G 2310/08; G09G 2330/12
See application file for complete search history.

(56) References Cited

U.S. PATENT DOCUMENTS 6,057,698 A * 5/2000 Heo ..... G01R 31/318505 324/750.03
9,099,029 B2 * 8/2015 Wu ..... G09G 3/2096
2002/0118312 A1 * 8/2002 Ishizuka ..... G09G 3/2022 348/797
2003/0034965 A1 * 2/2003 Kim ..... G09G 3/3696 345/211
2003/0189564 A1 * 10/2003 Lee ..... G09G 3/3648 345/212
2005/0122305 A1 * 6/2005 Murao ..... G02F 1/133382 345/101
2006/0125742 A1 * 6/2006 Sekiguchi ..... G09G 3/3406 345/80
2007/0132709 A1 * 6/2007 Kawaguchi ..... G09G 3/3406 345/102

(Continued)

FOREIGN PATENT DOCUMENTS

JP 2008256775 10/2008
JP 4667619 4/2011

(Continued)

*Primary Examiner* — Ibrahim Khan
(74) *Attorney, Agent, or Firm* — Innovation Counsel LLP

(57) ABSTRACT

Disclosed is a display apparatus including: a display panel including pixels connected with a plurality of gate lines and a plurality of data lines; a gate driver supplying gate signals to the gate lines; and a data driver supplying data voltages to the data lines. The data driver includes a temperature measurer generating a temperature signal of the data driver.

18 Claims, 6 Drawing Sheets

(56) References Cited

U.S. PATENT DOCUMENTS

| | | | | |
|---|---|---|---|---|
| 2008/0143652 | A1* | 6/2008 | Hasegawa | G09G 3/3233 345/77 |
| 2010/0033475 | A1* | 2/2010 | Choi | G09G 3/3648 345/214 |
| 2010/0321374 | A1* | 12/2010 | Correa | G09G 3/293 345/212 |
| 2011/0025666 | A1* | 2/2011 | Baek | G01K 7/01 345/211 |
| 2011/0316823 | A1* | 12/2011 | Otani | G09G 3/3688 345/204 |
| 2012/0146976 | A1* | 6/2012 | Lee | G09G 3/3688 345/211 |
| 2014/0085290 | A1* | 3/2014 | Yu | G09G 3/3291 345/212 |
| 2014/0111499 | A1* | 4/2014 | Jang | G09G 3/3696 345/212 |
| 2014/0375620 | A1* | 12/2014 | Chen | G09G 3/20 345/212 |

FOREIGN PATENT DOCUMENTS

| | | |
|---|---|---|
| JP | 2011112970 | 6/2011 |
| JP | 2013137423 | 7/2013 |
| KR | 10-1327114 | 11/2013 |
| KR | 10-1328955 | 11/2013 |

* cited by examiner

DISPLAY APPARATUS

CROSS-REFERENCE TO RELATED APPLICATIONS

A claim for priority under 35 U.S.C. §119 is made to Korean Patent Application No. 10-2014-0138447 filed on Oct. 14, 2014, in the Korean Intellectual Property Office, the entire contents of which are hereby incorporated by reference.

BACKGROUND

The inventive concepts described herein relate to a display apparatus, and more particularly, relate to a display apparatus capable of protecting a data driver from damages by measuring a temperature of the data driver every horizontal line.

A display apparatus is generally organized to have a display panel including a plurality of pixels for express an image, a gate driver supplying gate signals to the pixels, and a data driver supplying data voltages to the pixels.

The pixels are typically supplied with the gate signals by way of a plurality of gate lines. The pixels are supplied with the data voltages by way of a plurality of data lines in response to the gate signals. The pixels express gray scales according to the data voltages, thereby displaying an image.

While the display apparatus is operating, a temperature of the data driver IC could be elevated. Due to temperature elevation in the data driver IC, the components of the data driver IC could be damaged physically.

SUMMARY

One aspect of embodiments of the inventive concept is directed to provide a display apparatus capable of protecting a data driver from physical damage by measuring a temperature of the data driver every horizontal period.

In an embodiment, a display apparatus may include: a display panel including pixels connected to a plurality of gate lines and a plurality of data lines; a gate driver supplying gate signals to the gate lines; and a data driver supplying data voltages to the data lines. The data driver includes a temperature measurer generating a temperature signal of the data driver.

The display apparatus may further include: a voltage generator generating power voltages driving the gate driver and data driver; and a timing controller controlling on- and off-states of the voltage generator in accordance with the temperature signal.

The data driver may measure the temperature of the data driver every horizontal period under the control of the timing controller.

The timing controller may include: a transmission interface transferring a plurality of interface signals to the data driver; and memory configured to store the temperature signal. Each of the interface signals includes a data control signal controlling the data driver.

The data driver may include a plurality of source ICs connected respectively with a predetermined number of the data lines, each of the source ICs receiving a corresponding interface signal from the timing controller.

Each of the source ICs may generate the data voltages in response to the data control signal and the image data of the corresponding interface signal.

The source ICs may measure internal temperatures of the source ICs, sequentially and repeatedly, responding to the data control signals and output the measured internal temperature as the temperature signal.

An internal temperature of the source IC corresponding to each horizontal line may be measured every horizontal period.

The data control signal may include a monitoring signal, and each of the source ICs may measure an internal temperature of the source IC in response to activation of the monitoring signal of the corresponding interface signal and output the measured internal temperature as the temperature signal.

The monitoring signal may be transferred by allocating one of bits that are prepared to transfer the data control signal.

The monitoring signal may be sequentially activated in the interface signals during horizontal periods, and repeatedly activated i corresponding to the number of the source ICs.

Each of the source ICs may include a reception interface receiving the corresponding interface signal and a temperature measurer measuring an internal temperature of the corresponding source ICs in response to the activation of the monitoring signal.

The temperature measurer may include: a temperature sensor configured to sense the internal temperature the source ICs and outputting a temperature voltage corresponding to the sensed temperature; and a comparator including a positive terminal supplied with the temperature voltage, and a negative terminal coupled with a reference voltage corresponding to a temperature under which the source ICs operate normally.

The comparator may output the temperature signal if the temperature voltage is higher than the reference voltage.

The timing controller may turn off the voltage generator if the temperature signal is supplied more than predetermined times from any one of the source ICs.

The predetermined times is once.

The temperature signal output from each of the source ICs may be stored in a corresponding bit of the memory.

The interface signal may further include a line start signal informing a beginning of line and a horizontal blank signal for blank period. The line start signal, the data control signal, the image data and the horizontal blank signal are output in sequence, and the temperature signal may be supplied to the timing controller during the horizontal blank signal.

The timing controller may output a gate control signal and the gate driver sequentially outputs the gate signals in response to the gate control signal.

BRIEF DESCRIPTION OF THE FIGURES

The above and other objects and features will become apparent from the following description with reference to the following figures, wherein like reference numerals refer to like elements throughout the various figures unless otherwise specified, and wherein.

DETAILED DESCRIPTION

Figure 1:
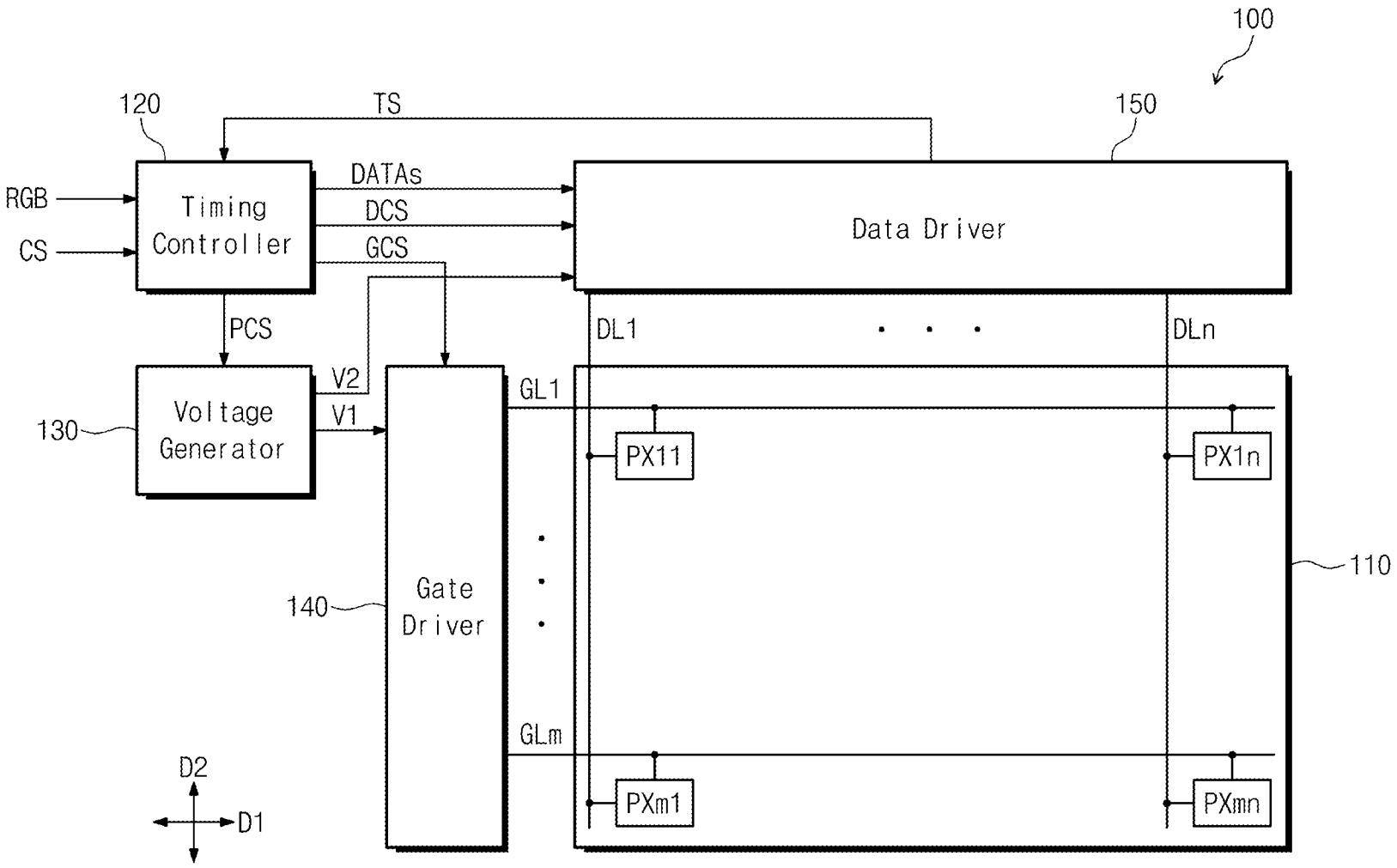
FIG. 1 is a block diagram illustrating a display apparatus according to embodiments of the inventive concept.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present between the two layers.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present between the element or layer and the other element or layer. In contrast, when an element is referred to as being "directly on," "directly connected to", "directly coupled to", or "immediately adjacent to" another element or layer, there are no intervening elements or layers present between the element or layer and the other element or layer.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Now hereinafter will be described exemplary embodiments of the inventive concept in conjunction with accompanying drawings.

FIG. 1 is a block diagram illustrating a display apparatus according to embodiments of the inventive concept.

Referring to FIG. 1, the display apparatus 100 includes a display panel 110, a timing controller 120, a voltage generator 130, a gate driver 140, and a data driver 150.

The display panel 110 includes a plurality of gate lines GL1 through GLm, a plurality of data lines DL1 through DLn, and a plurality of pixels PX11 through PXmn. The gate lines GL1 through GLm are connected to the gate driver 140, extending in a first direction D1. The data lines DL1 through DLn are connected to the data driver 150, extending in a second direction D2 intersecting the first direction D1. Here, m and n are positive integers.

The pixels PX11 through PXmn are disposed at regions comparted by the gate and data lines GL1 through GLm and DL1 through DLn intersecting with each other. Therefore, the pixels PX11 through PXmn may be arranged in a pattern of matrix. The pixels PX11 through PXmn are connected to their corresponding gate and data lines GL1 through GLm and DL1 through DLn.

Each pixel PX may express one of primary colors. The primary colors may include red, green, and blue. But, without being restrictive hereto, the primary colors may further include other diverse colors such as white, yellow, cyan, magenta, and so on.

Although not shown, the timing controller 120 may be mounted on a printed circuit board in a form of integrated circuit chip and connected to the gate and data drivers 140 and 150. The timing controller 120 receives image signals RGB and control signals CS from an external system (e.g. a system board).

The timing controller 120 converts the image signals RGB, in data formats, to meet interface specifications with the data driver 150. The timing controller 120 supplies image data DATAs, which are converted in data formats, to the data driver 150.

The timing controller 120 generates a power control signal PCS to control on- and off-states of the voltage generator 130. Additionally, the timing controller 120 generates a gate control signal GCS and a data control signal DCS in response to the control signals CS.

The gate control signal GCS is provided for controlling operation timings of the gate driver 140. The data control signal DCS is provided for controlling operation timings of the data driver 150.

The timing controller 120 applies the power control signal PCS to the voltage generator 130. The timing controller 120 applies the gate control signal GCS to the gate driver 140 and applies the data control signal DCS to the data driver 150.

The voltage generator 130 increases and decreases an input voltage, which is supplied from an external system (e.g. a system board), to generate a first power voltage V1 and a second power voltage V2. The first power voltage V1 is provided for driving the gate driver 140. The second power voltage V2 is provided for driving the data driver 150.

Although not shown, the voltage generator 130 may generate a voltage for driving the display panel 110. For instance, if the display panel 110 is a kind of liquid crystal display panel including a couple of substrates opposite to each other and a liquid crystal layer interposed between the two substrates, the voltage generator 130 may generate a common voltage to be supplied to the liquid crystal display panel.

The gate driver 140 generates and outputs gate signals in response to the gate control signal GCS. The gate signals may be output in sequence. The gate signals are applied to the pixels PX11 through PXmn through the gate lines GL1 through GLm.

The data driver 150 generates and outputs analogue data voltages, which correspond to the image data DATAs, in response to the data control signal DCS. The data voltages are supplied to the pixels PXs by way of the data lines DL1 through DLn.

Although not shown, the gate and data drivers, 140 and 150, may be formed of a plurality of drive chips mounted on a printed circuit board, and connected to the display panel 110 in the manner of Tape Carrier Package (TCP).

But, without being restrictive hereto, the gate and data drivers, 140 and 150, may be formed of a plurality of drive chips mounted on the display panel 110 in the manner of Chip-On-Glass (COG). Additionally, the gate driver 140 may be formed together with transistors of the pixels PXs and mounted on the display panel 110 in the form of Amorphous Silicon thin-film-transistor Fate driver (ASG).

The pixels PX are supplied with the data voltages by way of the data lines DL1 through DLn in response to the gate signals supplied through the gate lines GL1 through GLm. The pixels PX display an image by expressing their gray scales corresponding to the data voltages.

The data driver 150 measures its internal temperature every horizontal period in response to the data control signal DCS. The horizontal period is defined as a time for driving the pixels connected respectively with the gate lines GL1 through GLm.

The pixels connected respectively with the gate lines GL1 through GLm may be defined as a pixel row. In other words, an internal temperature of the data driver 150 may be measured every horizontal period.

The data driver 150 supplies a temperature signal TS, which is made from the measurement of temperature, to the timing controller 120. The timing controller 120 may control on- and off-states of the voltage generator 130 in response to the temperature signal TS.

If the temperature signal TS has a low level (logically '0'), the timing controller 120 applies the power control signal PCS to the voltage generator 130, in response to the temperature signal TS, to turn on the voltage generator 130. Therefore, the voltage generator 130 may be held in its on-state in response to the power control signal PCS and may generate the first and second voltages V1 and V2.

If the temperature signal TS has a high level (logically '1'), the timing controller 120 applies the power control signal PCS to the voltage generator 130, in response to the temperature signal TS, to turn off the voltage generator 130. Therefore, the voltage generator 130 is turned off in response to the temperature signal TS, hence not generating the first and second power voltages V1 and V2. Accordingly, the display panel 110 is not driven.

As a result, it is allowable for the display apparatus 100 to protect the data driver 150 by measuring a temperature of the data driver 150 every horizontal period.

Figure 2:
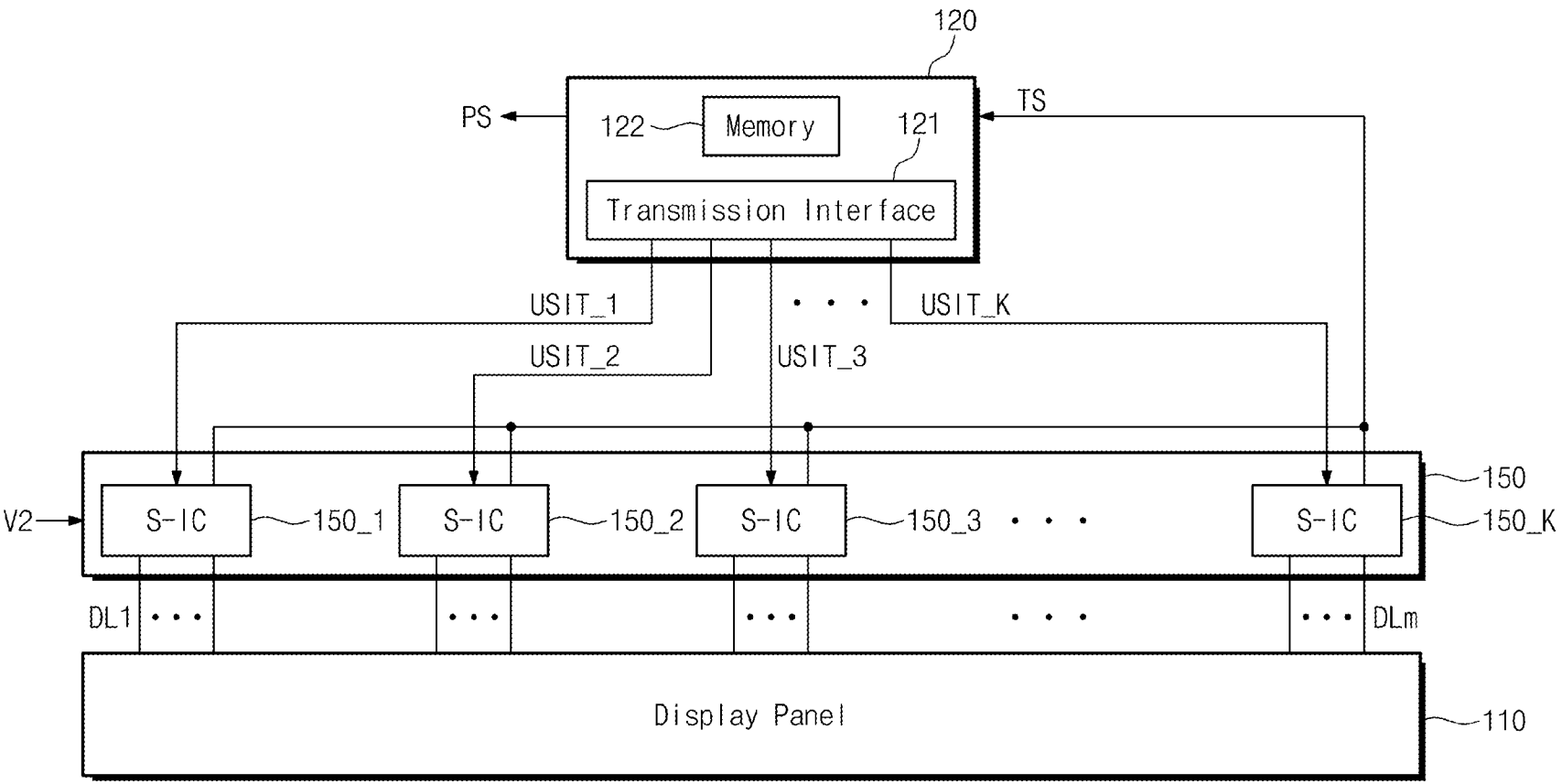
FIG. 2 illustrates a functional structure of the timing controller and the data driver shown in FIG. 1.

FIG. 2 illustrates a functional structure of the timing controller and the data driver shown in FIG. 1.

Referring to FIG. 2, the timing controller 120 includes a transmission interface unit 121 to transfer a plurality of interface signals USIT_1 through USIT_k to the data driver 150, and a memory 122 to store the temperature signal TS. Here, k has a positive integer larger than 0 but smaller than n. The interface signals USIT-1 through USIT_k each include the data control signal DCS and the image data DATAs.

The data driver 150 includes a plurality of source integrated circuits (S-ICs) 150_1 through **150_*k* corresponding respectively to the interface signals USIT1 through USIT_k. The source ICs 150_1 through 150_*k* receive corresponding interface signals USIT_1** through USIT_k respectively.

The source ICs 150_1 through **150_*k* are connected to corresponding data lines DL1 through DLn respectively. The source ICs 150_1 through 150_*k* are connected to a predetermined number of the data lines DL1** through DLn.

The source ICs 150_1 through **150_*k* generates the data voltages in response to the corresponding image data and data control signals of the interface signals USIT_1 through USIT_k respectively. The source ICs 150_1 through 150_*k*** supplies the data voltages correspondingly to the predetermined number of the data lines.

Additionally, the source ICs 150_1 through **150_*k* measure their internal temperatures in response to the corresponding data control signals DCS of the interface signals USIT_1 through USIT_k respectively. The source ICs 150_1 through 150_*k*** measure their internal temperature every pixel row. This operation will be explained in detail hereinafter.

Each of the source ICs 150_1 through **150_*k* applies the temperature signal TS, which is made from the measured temperature, to the timing controller 120. As aforementioned, the timing controller 120 generates the power control signal PCS, which is used to control on- and off-states of the voltage generator 130, in response to the temperature signal TS. Additionally, the temperature signal TS is stored in the memory 122 of the timing controller 120**.

Figure 3:
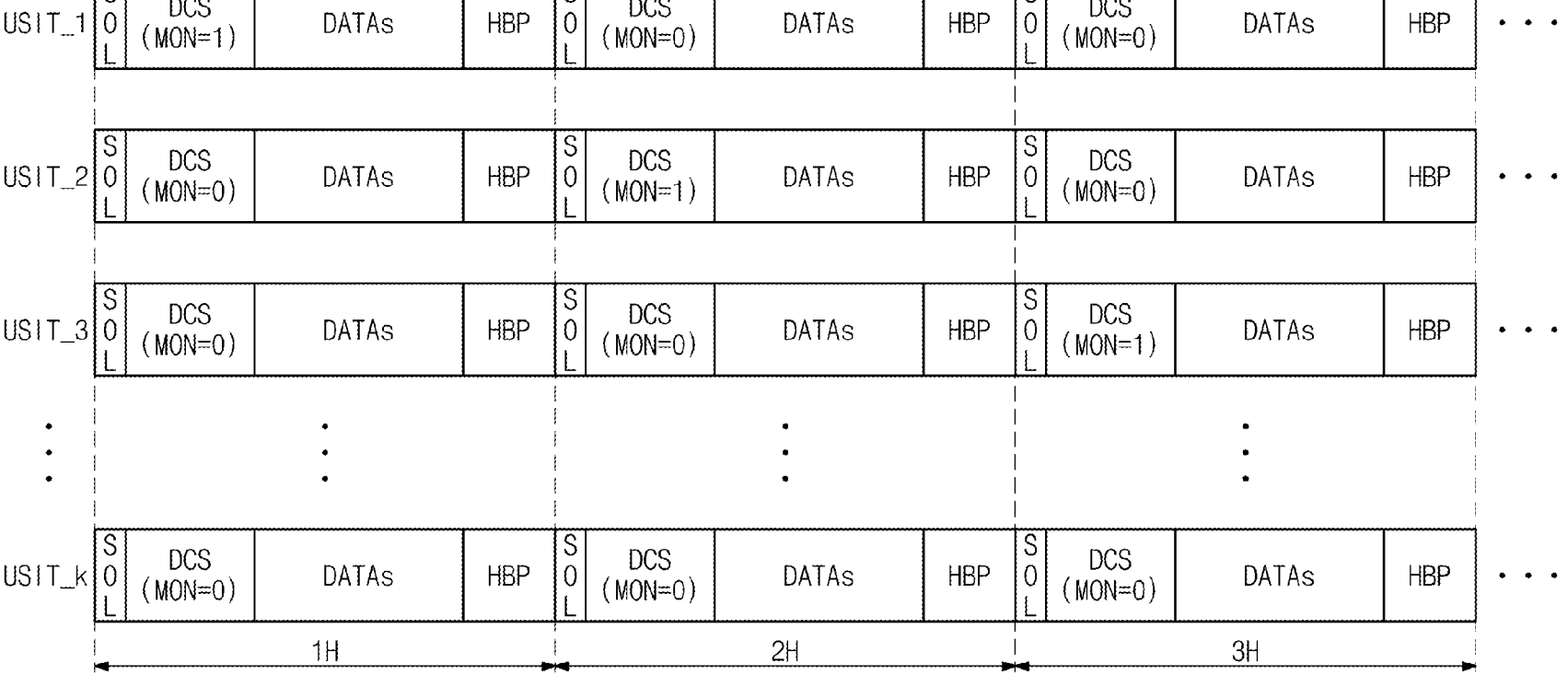
FIGS. 3 and 4 show configurations and transfer sequences of interface signals shown in FIG. 2.
Figure 4:
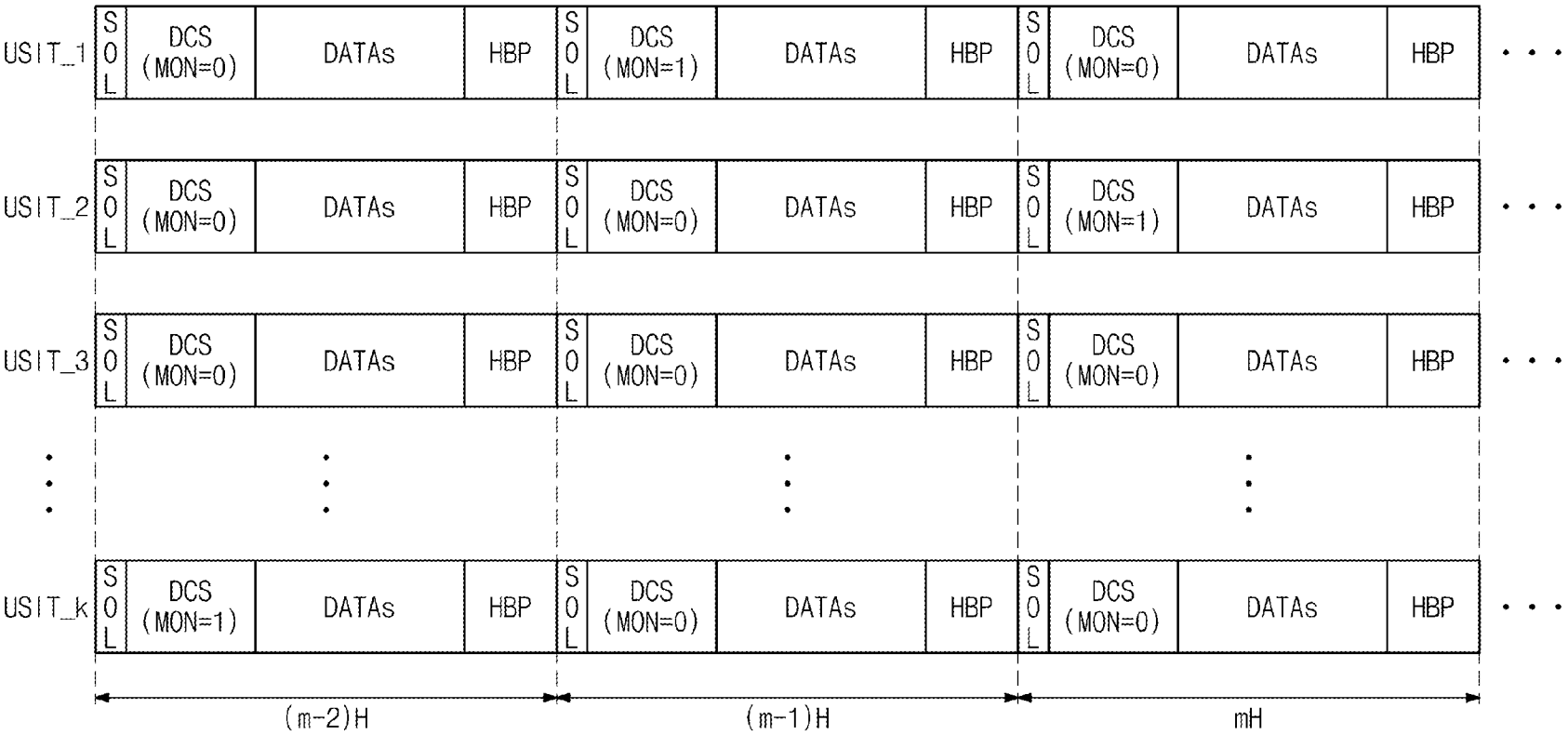

FIGS. 3 and 4 show configurations and transfer sequences of interface signals shown in FIG. 2.

Referring to FIGS. 3 and 4, each of the interface signals USIT_1 through USIT_k includes a line start signal SOL which informs a beginning of line, the data control signal DCS to control its corresponding source IC, the image data DATAs corresponding to the data voltages, and a horizontal blank signal HBP for blank period.

As shown in FIGS. 3 and 4, the line start signal SOL, the data control signal DCS, the image data DATAs and the horizontal blank signal HBP may be output in sequence from the transmission interface unit 121.

The data control signal DCS may include a monitoring signal MON, a data start signal, a load signal, and a polarity control signal. The monitoring signal MON is provided for sensing a temperature of the corresponding source IC.

The monitoring signal MON may be transferred by allocating a specific bit, among bits for transferring the data control signal DCS, therefor. One bit may be allocated for the monitoring signal MON. Therefore, the monitoring signal MON may be set as a logical binary '1' or '0'.

If the monitoring signal MON has a high level (logically '1') as an active state, the source IC supplied with this monitoring signal MON performs the temperature sensing operation. If the monitoring signal MON has a low level (logically '0') as an inactive state, the source IC provided with this monitoring signal MON does not perform the temperature sensing operation.

The source ICs 150_1 through **150_*k* will be hereinbelow referred to as first through k'th source ICs 150_1 through 150_*k* in accordance with their arrangement order. Additionally, the interface signals USIT_1 through USIT_k corresponding to the source ICs 150_1 through 150_*k* are referred to as first through k'th interface signals USIT_1** through USIT_k.

As the pixels connected to the gate lines GL1 through GLm are disposed along horizontal lines, the horizontal lines are formed of first through m'th horizontal lines. Therefore, the horizontal periods are formed of first through m'th horizontal periods corresponding respectively to the first through m'th horizontal lines.

Every horizontal period, the first through k'th interface signals USIT_1 through USIT_k are supplied to the first through k'th source ICs 150_1 through **150_*k*. Every horizontal period, the first through k'th source ICs 150_1 through 150_*k* generate the data voltages in response to the first through k'th interface signals USIT_1** through USIT_k. The data voltages are supplied to the pixels disposed along the horizontal lines, corresponding to the horizontal periods, every horizontal period.

In detail, in the first horizontal period 1H, the first through k'th interface signals USIT_1 through USIT_k are supplied to the first through k'th source ICs 150_1 through **150_*k*. The first through k'th source ICs 150_1 through 150_*k* generate the data voltages, which are to be supplied to the pixels PX11 through PX1*n* disposed along the first horizontal line corresponding to the first horizontal period 1H, in response to the first through k'th interface signals USIT_1** through USIT_k.

The pixels PX11 through PX**1*n* disposed at the first horizontal line are supplied with the data voltages in response to the gate signal applied by way of the first gate line GL1**.

In the second horizontal period 2H, the first through k'th source ICs 150_1 through **150_*k* generate the data voltages, which are to be supplied to the pixels PX21 through PX2*n* disposed along the second horizontal line corresponding to the second horizontal period 2H, in response to the second through k'th interface signals USIT_1 through USIT_k. The pixels PX21 through PX2*n* disposed at the second horizontal line are supplied with the data voltages in response to the gate signal applied by way of the second gate line GL2**.

This operation proceeds until the m'th horizontal period that corresponds to the m'th horizontal line. That is, the aforementioned operation is repeatedly carried out in the first through m'th horizontal periods in order to drive the pixels disposed at the first through m'th horizontal lines.

In the horizontal periods, the first through k'th source ICs 150_1 through **150_*k*** measure, sequentially and repeatedly, their internal temperatures in response to the monitoring signals MON of the data control signals DCS.

In detail, during the first through m'th horizontal periods, the monitoring signals MON are sequentially activated in the sequence of the first through k'th interface signals USIT_1 through USIT_k. Additionally, in the first through m'th horizontal periods, the monitoring signals MON are repeatedly activated k times corresponding to the number of the first through k'th source ICs 150_1 through **150_*k***.

For example, the monitoring signal MON of the first interface signals USIT_1 through the USIT_K are activated during the first horizontal period 1H. The first interface signals USIT_1 through the USIT_K are activated in sequence.

The activated monitoring signals MON are sequentially and repeatedly applied to the first through k'th source ICs 150_1 through **150_*k*** in the first through m'th horizontal periods. As a result, the monitoring signal MON is applied to the corresponding source ICs every horizontal period.

Each of the source ICs 150_1 through **150_*k* measures its internal temperature in response to the activated monitoring signal MON and transfers the temperature signal TS, which is made from the temperature measurement, to the timing controller 120. The temperature signal TS may be transferred to the timing controller 120** in the horizontal blank period during which the horizontal blank signal HBP is transferred.

Exemplarily, the first source IC 150_1 measures its internal temperature in response to the activated monitoring signal MON of the first interface signal USIT_1 in the first horizontal period 1H.

The temperature signal TS obtained from the first source IC 150_1 may be transferred during the period of the horizontal signal HBP of the first interface signal USIT_1. Consequently, every horizontal period, a temperature of the source IC corresponding to the horizontal period is measured and the temperature signal TS thereof is transferred to the timing controller 120.

As aforementioned, the temperature signal TS is stored in the memory 122 of the timing controller 120. The temperature signal TS stored in the memory 122 may enable to detect an abnormal temperature from the source ICs 150_1 through **150_*k***.

For instance, as the temperature signal TS generated from any one of the source ICs has '0' or '1', it may need one bit of the memory 122. Therefore, the temperature signals output from the source ICs 150_1 through **150_*k* may be stored in their corresponding bit positions of the memory 122**.

By means of the temperature signals TS stored in the memory 122, it is possible to recognize a source IC having abnormal temperature. The source IC having abnormal-temperature may be replaced.

Figure 5:
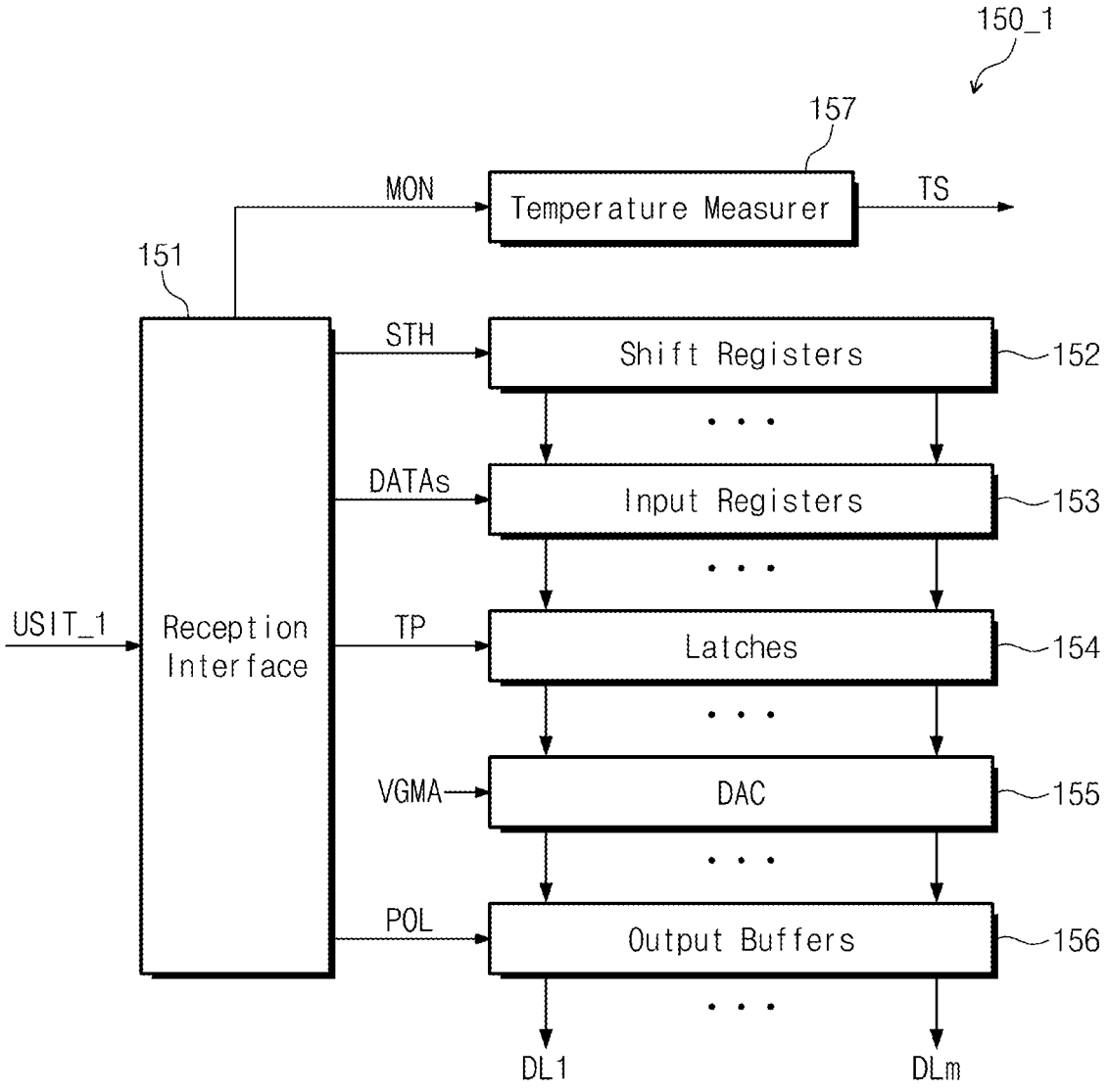
FIG. 5 illustrates a functional structure of the first source IC shown in FIG. 2.

FIG. 5 illustrates a functional structure of the first source IC 150_1 shown in FIG. 2.

Although not shown in FIG. 5, the second through k'th source ICs 150_2 through **150_*k* may have the same structure as the first source ICs 150_1**.

Referring to FIG. 5, the first source IC 150_1 includes a reception interface 151, shift registers 152, input registers 153, latches 154, a digital-analogue converter 155, output buffers 145, and a temperature measurer 157.

The reception interface 151 receives the first interface signal USIT_1 from the timing controller 120. The data start signal STH of the first interface signal USIT_1 is applied to the shift registers 152 by way of the reception interface 151.

The image data DATAs of the first interface signal USIT_1 are supplied to the input registers 153 by way of the reception interface 151.

The load signal TP of the first interface signal USIT_1 is supplied to the larches 154 by way of the reception interface 151. The polarity control signal POL of the first interface signal USIT_1 is applied to the output buffers 156 by way of the reception interface 151. The monitoring signal MON of the first interface signal USIT_1 is applied to the temperature measurer 157 by way of the reception interface 151.

The shift registers 152 generate sampling signals from the data start signal STH and data sync clocks. The shift registers 152 generate n-numbered sampling signals ever cycle of the data sync clocks. Corresponding to the n-numbered sampling signals, the shift registers 152 are formed to include n-numbered shift registers. The sampling signals are supplied to the input registers 153.

The input registers 153 sequentially store the image data DATAs in response to the sampling signals which are provided in sequence from the shift registers 152. The input registers 153 store n-numbered image data DATAs, which correspond to the amount of one horizontal line, in response to the sampling signals. The input registers 153 include n-numbered data input latches for latching and storing the n-numbered image data DATAs.

The latches 154 store the image data DATAs, which have been held in the input registers 153, at a time in response to the load signal TP. In order to store the image data DATAs of one horizontal line, the latches 154 are used as data storage latches in the same number with the data input latches of the input registers 153. The latches 154 supply the image data DATAs to the digital-analogue converter 155.

The digital-analogue converter 155 generates gray-scale indication voltages, which correspond to the image data DATAs, by means of gamma voltages VGMA supplied from a gamma voltage generator (not shown). The gray-scale indication voltages are supplied to the output buffers 156.

The output buffers 156 current-amplifies and outputs the gray-scale indication voltages, which are supplied from the digital-analogue converter 154, as the data voltages. The output buffers 156 determine polarities of the data voltages in response to the polarity control signal POL.

The temperature measurer 157 operates to measure an internal temperature of the first source IC 150_1, responding to the activated monitoring signal MON, and therefrom apply the temperature signal TS to the timing controller 120.

Figure 6:
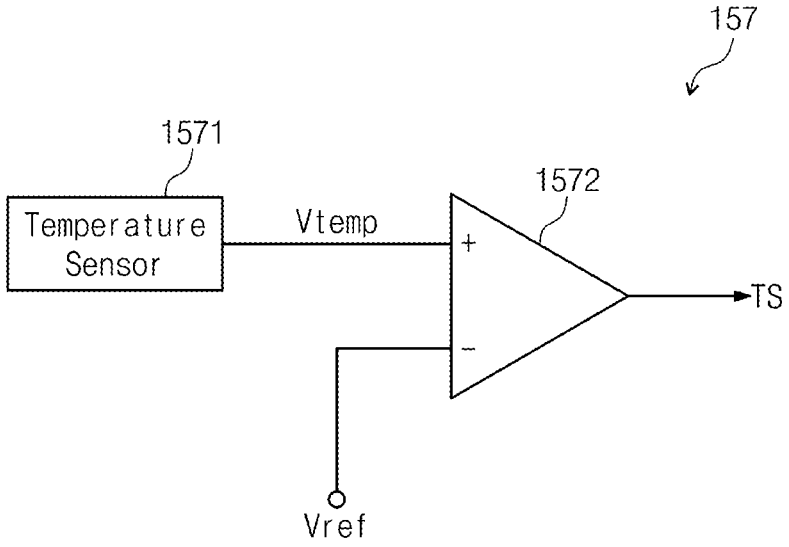
FIG. 6 illustrates a functional structure of the temperature measurer shown in FIG. 5.

FIG. 6 illustrates a functional structure of the temperature measurer 157 shown in FIG. 5.

Referring to FIG. 6, the temperature measurer 157 includes a temperature sensor 1571 and a comparator 1572. The temperature measurer 1571 senses an internal temperature of the first source IC 150_1 and supplies a temperature voltage Vtemp, which corresponds to the sensed temperature, to a positive terminal (+) of the comparator 1572.

A negative terminal (−) of the comparator 1572 is supplied with a reference voltage Vref. The reference voltage Vref may be set on a voltage corresponding to a temperature under which the first through k'th source ICs 150_1 through **150_*k*** can be driven in normal conditions.

The comparator 1572 activates the temperature signal TS, which is output with high level, if the temperature voltage Vtemp is higher than the reference voltage Vref. The comparator inactivates the temperature signal TS, which is output with low level, if the temperature voltage Vtemp is lower than the reference voltage Vref.

As aforementioned, the timing controller 120 turns off the voltage generator 130 in response to the activated temperature signal TS. Thus, the source ICs 150_1 through **150_*k* of the data driver 150 are not driven when the temperature signal TS is activated. The timing controller 120 maintains the voltage generator 130** in an on-state in response to the inactivated temperature signal TS.

Elevating temperatures of the source ICs 150_1 through **150_*k* over a normal temperature would physically damage the source ICs 150_1 through 150_*k*. However, according to embodiments of the inventive concept, if any one of the source ICs 150_1 through 150_*k* is detected as having a temperature higher than the normal temperature every horizontal line, the voltage generator 130 is turned off to disable the data driver 150. Consequently, the source ICs 150** can be protected from physical damaging due to an abnormal temperature.

The activated temperature signal TS may be referred to as a temperature disorder signal. In an embodiment, once there is an output of the temperature disorder signal from any one of the source ICs 150_1 through **150_*k*, the voltage generator 130 is shut down. But, without restrictive hereto, the number of times of generating the temperature disorder signal may be differently set to disable the voltage generator 130**.

The temperature disorder signal may be generated due to noises. If the temperature disorder signal is output more than 100 times from each of the source ICs 150_1 through **150_*k*, the source ICs 150_1 through 150_*k*, the source ICs may be damaged physically. If the temperature disorder signal is output less than 100 times from each of the source ICs 150_1 through 150_*k*, the source ICs 150_1 through 150_*k***, the source ICs may not be damaged physically.

In this case, the number of times to shut down the voltage generator may be set to 100 times from any one of the source ICs 150_1 through 150_.

Consequently, the display apparatus 100 is advantageous to protecting the source ICs 150 from physical damages by measuring a temperature of the data driver every horizontal line.

While the inventive concept has been described with reference to exemplary embodiments, it will be apparent to those skilled in the art that various changes and modifications may be made without departing from the spirit and scope of the present inventive concept. Therefore, it should be understood that the above embodiments are not limiting the scope of the inventive concept, but illustrative.

What is claimed is:

1. A display apparatus comprising:

a display panel including pixels connected with a plurality of gate lines and a plurality of data lines;

a gate driver configured to supply gate signals to the gate lines; and a data driver configured to supply data voltages to the data lines, the data driver including a temperature measurer generating a temperature signal of the data drive;

a voltage generator configured to generate power voltages driving the gate driver and data driver; and a timing controller configured to control on- and off-states of the voltage generator in accordance with the temperature signal.

2. The display apparatus according to claim 1, wherein the data driver is configured to measure the temperature of the data driver every horizontal period under the control of the timing controller.

3. The display apparatus according to claim 1, wherein the timing controller comprises:

a transmission interface configured to transfer a plurality of interface signals to the data driver; and a memory configured to store the temperature signal, wherein each of the interface signals includes a data control signal controlling the data driver.

4. The display apparatus according to claim 3, wherein the data driver includes a plurality of source ICs connected respectively with a predetermined number of the data lines, each of the source ICs receiving a corresponding interface signal from the timing controller.

5. The display apparatus according to claim 4, wherein each of the source ICs is configured to generate the data voltages in response to the data control signal and the image data of the corresponding interface signal.

6. The display apparatus according to claim 4, wherein the source ICs are configured to measure internal temperatures of the source ICs, sequentially and repeatedly, responding to the data control signals and output the measured internal temperature as the temperature signal.

7. The display apparatus according to claim 4, wherein an internal temperature of the source IC corresponding to each horizontal line is measured every horizontal period.

8. The display apparatus according to claim 4, wherein the data control signal includes a monitoring signal and each of the source ICs is configured to measure an internal temperature of the source IC in response to activation of the monitoring signal of the corresponding interface signal and output the measured internal temperature as the temperature signal.

9. The display apparatus according to claim 8, wherein the monitoring signal is transferred by allocating one of bits that are prepared to transfer the data control signal.

10. The display apparatus according to claim 8, wherein the monitoring signal is sequentially activated in the interface signals during horizontal periods, and repeatedly activated corresponding to the number of the source ICs.

11. The display apparatus according to claim 8, wherein each of the source ICs includes:

a reception interface configured to receive the corresponding interface signal; and a temperature measurer configured to measure an internal temperature of corresponding source ICs in response to the activation of the monitoring signal.

12. The display apparatus according to claim 11, wherein the temperature measurer comprises:

a temperature sensor configured to sense the internal temperature of the source ICs and output a temperature voltage corresponding to the sensed temperature; and a comparator including a positive terminal supplied with the temperature voltage, and a negative terminal coupled with a reference voltage corresponding to a temperature under which the source ICs operate normally.

13. The display apparatus according to claim 12, wherein the comparator is configured to output the temperature signal if the temperature voltage is higher than the reference voltage.

14. The display apparatus according to claim 4, wherein the timing controller is configured to turn off the voltage generator if the temperature signal is supplied more than predetermined times from any one of the source ICs.

15. The display apparatus according to claim 14, wherein the predetermined times is once.

16. The display apparatus according to claim 4, wherein the temperature signal output from each of the source ICs is stored in a corresponding bit of the memory.

17. The display apparatus according to claim 4, wherein the interface signal further includes a line start signal informing a beginning of line and a horizontal blank signal for blank period, wherein the line start signal, the data control signal, the image data and the horizontal blank signal are output in sequence, and the temperature signal is supplied to the timing controller during the horizontal blank signal.

18. The display apparatus according to claim 1, wherein the timing controller is configured to output a gate control signal and the gate driver sequentially outputs the gate signals in response to the gate control signal.

* * * * *